US007850446B2

(12) United States Patent
Tsai

(10) Patent No.: US 7,850,446 B2
(45) Date of Patent: Dec. 14, 2010

(54) HAND-HELD GAS COMBUSTION APPARATUS

(76) Inventor: Chih-Lin Tsai, No. 94, Sec. 4, Chung Hsin Road, San Chung City, Taipei Hsien (TW)

( * ) Notice: Subject to any disclaimer, the term of this patent is extended or adjusted under 35 U.S.C. 154(b) by 320 days.

(21) Appl. No.: 12/204,737

(22) Filed: Sep. 4, 2008

(65) Prior Publication Data

US 2009/0068606 A1 Mar. 12, 2009

(30) Foreign Application Priority Data

Sep. 12, 2007 (TW) ..... 96215273 U

(51) Int. Cl.
*F23D 14/72* (2006.01)
*F23Q 1/04* (2006.01)

(52) U.S. Cl. ..... 431/255; 431/153; 431/344; 431/345; 431/254

(58) Field of Classification Search ..... 431/155, 431/253, 344
See application file for complete search history.

(56) References Cited

U.S. PATENT DOCUMENTS 5,466,149 A * 11/1995 Tsai ..... 431/344
6,293,782 B1 * 9/2001 Tsai ..... 431/153
6,296,475 B1 * 10/2001 Tsai ..... 431/153
7,708,554 B2 * 5/2010 Tsai ..... 431/153
2007/0281262 A1 * 12/2007 Johnston et al. ..... 431/153

FOREIGN PATENT DOCUMENTS

TW 582519 * 6/2003

* cited by examiner

*Primary Examiner*—Steven B McAllister
*Assistant Examiner*—Nikhil Mashruwala
(74) *Attorney, Agent, or Firm*—Guice Patents PLLC

(57) ABSTRACT

The present invention relates to a hand-held gas combustion apparatus, comprises a gas storing tank, a gas discharging device, a housing, an ignition system and a flame device. The flame nozzle of the flame device and the metal sleeve tube are respectively in contact with the conductive wire and the electricity-guiding wire of the ignition system, so a static electricity spark is generated between the inner folding edge of the metal sleeve tube and the flame nozzle, so mixed combustion gas ejected from the flame nozzle is ignited, a gas combustion apparatus is therefore obtained, and the electricity-guiding wire is provided between the metal sleeve tube and the ignition system so the high-voltage static electricity can be guided back to the ignition system for forming a circuit. The present invention has overcome the disadvantages that a conductive wire of a conventional ignition system has to be provided at one side of the flame nozzle and the inconvenience of circuit design, and in the present invention there is no need of providing additional supporting racks for receiving and positioning the ignition system and the flame device.

17 Claims, 5 Drawing Sheets

HAND-HELD GAS COMBUSTION APPARATUS

BACKGROUND OF THE INVENTION

1. Field of the Invention

The present invention relates to a gas combustion apparatus, more particularly to a hand-held gas combustion apparatus.

2. Description of Related Art

Fire is a must-have matter in human being's daily life, with fire we can cook food, have lights, even operating casting, melting or welding metals. Take a canned gas for instance, no matter the canned gas is served to fill a lighter for lightening or is connected to a portable gas burner for cooking food; thus the convenience of using a canned gas is provided, and the canned gas is easy to be carried and stored. So far the canned gas still plays an important part in daily life.

Due to the convenience of using a canned gas, two kinds of gas combustion tools are both seen in the marketplace so a user can make his own decision. The U.S. Pat. No. 5,466,149 (corresponding to the Taiwan Utility Patent No. 110192) and the U.S. Pat. No. 5,564,919 (corresponding to the Taiwan Utility Patent No. 112652) both granted to the applicant of the present invention have disclosed that a gas discharging valve provided on a top end of a canned gas is pivotally connected to a filling nozzle provided in the bottom end of a heating torch, so liquefied gas can be filled into a fuel storing tank for supplying gas to a gas discharging device and supplying fuel to a flame device for combustion. The U.S. Pat. No. 5,735,353 (corresponding to the Taiwan Utility Patent No. 134495) and the U.S. Pat. No. 5,816,794 (corresponding to the Taiwan Utility Patent No. 122521) both granted to the applicant of the present invention have disclosed that a supporting device is provided at the bottom end for being pivotally connected to a canned gas commercially available on the market, fuel in the canned gas is vaporized then served as a fuel source for the combustion apparatus for operations such as melting or welding.

The U.S. Pat. No. 5,531,592 (corresponding to the Taiwan Utility Patent No. 91341) granted to the applicant of the present invention has disclosed that a conventional lighter is served as a fuel source, and combustion gas passes through a gas discharging device and a combustion device then the combustion gas is mixed and is ignited by a piezoelectric device, so a hand-held gas combustion apparatus is obtained.

Various combustion devices are developed and are used according to user's needs. But to ignite a flame device for operating a combustion operation, a conductive wire of an ignition system is often provided and extended to one side of a flame nozzle of a flame device; so when the ignition system is pressed, high-voltage static electricity is transferred via the conductive wire therefore a spark is negated between the end section of the wire and the flame nozzle, and the mixed combustion gas discharged from the flame nozzle is ignited, so a combustion operation can be operated. In view of the above mentioned art, the conductive wire has to be extended and fastened at one side of the flame nozzle, but on some occasions the flame device has limited space and the conductive wire is not able to pass through the limited space, thus the flame device is not able to be ignited. Even if the flame device has an sufficient space to allow the conductive wire pass through, the conductive wire may be in contact with the flame device and combustion heat from the flame nozzle is transferred to the flame device, so the insulating sleeve tube of the conductive wire is melted by the heat and a static electricity spark can not be ensured to be generated on the flame nozzle.

SUMMARY OF THE INVENTION

The applicant of the present invention has devoted himself to design and commercially distribute gas combustion apparatuses and combustion tools, and based on the existing granted patents and hard work, the applicant of the present invention has been developing novel combustion related tools and apparatus, and hopes to provide a combustion apparatus in which a flame nozzle of a flame device and a metal sleeve tube are respectively in contact with a conductive wire and an electricity-guiding wire of an ignition system, so a static electricity spark is generated between the flame nozzle and an inner folding edge of the metal sleeve tube, then mixed combustion gas ejected from the flame nozzle, and the electricity-guiding wire is provided between the metal sleeve tube and the ignition system so as to form a circuit, after try and error, the present invention "hand-held gas combustion apparatus" is provided.

For achieving the objects mentioned above, the present invention provides a hand-held gas combustion apparatus, comprises: a gas storing tank, an opening is provided on a tank top provided at a top end of a tank body, a tank bottom is provided at the bottom end of the tank body and is provided with a gas filling nozzle; a gas discharging device, a discharging nozzle is provided on the opening for controlling the supplying/ceasing of combustion gas, the discharging nozzle is connected to a gas conveying tube and the other end thereof is connecting to an ejecting nozzle; a housing composed by two cover members connecting together, so a housing tenon and a button hole are respectively formed on the two lateral ends, and a connecting ring provided at the bottom end is connected to the tank top of the gas storing tank, a polygonal positioning hole is axially provided on the housing tenon and the top end and the bottom end of the housing tenon is respectively and in parallel provided with a linear slot; an ignition system, a piezoelectric device is fastened in the housing and the rear end of the piezoelectric device is connected to a button extruding out of the button hole, the button is extrudingly provided with a pushing rod that can be served to actuate a discharging sheet so the discharging nozzle is operated to supply gas, a conductive wire is extended from the piezoelectric device and is received in one of the linear slots, and the metal exposed portion of the conductive wire is fastened in the positioning hole, and one end of an electricity-guiding wire defined as a connecting end is connected to a metal electricity-guiding section of the piezoelectric device, and the other end thereof defined as a contacting end is extended into the other linear slot; a flame device, a polygonal tube end defined at a rear end of a mixing tube is clamped in the positioning hole so as to be in contact with the conductive wire, and the tube end is served to let the ejecting nozzle being mounted into, at least one air intake hole is provided at the lateral side of the mixing tube, and the front end of the mixing tube is provided with a flame nozzle, and a metal sleeve tube is connected to a connecting ring then the connecting ring is connected to the housing tenon, so the contacting end of the electricity-guiding wire is in contact with the rear end of the sleeve tube, and the flame nozzle is provided in front of the sleeve tube, a small distance is generated between an inner folding edge provided at the front end of the sleeve tube and the flame nozzle for generating a high-voltage static electricity spark which is served to ignite the mixed combustion gas ejected from the flame nozzle.

DETAILED DESCRIPTION OF THE PREFERRED EMBODIMENT

Figure 1:
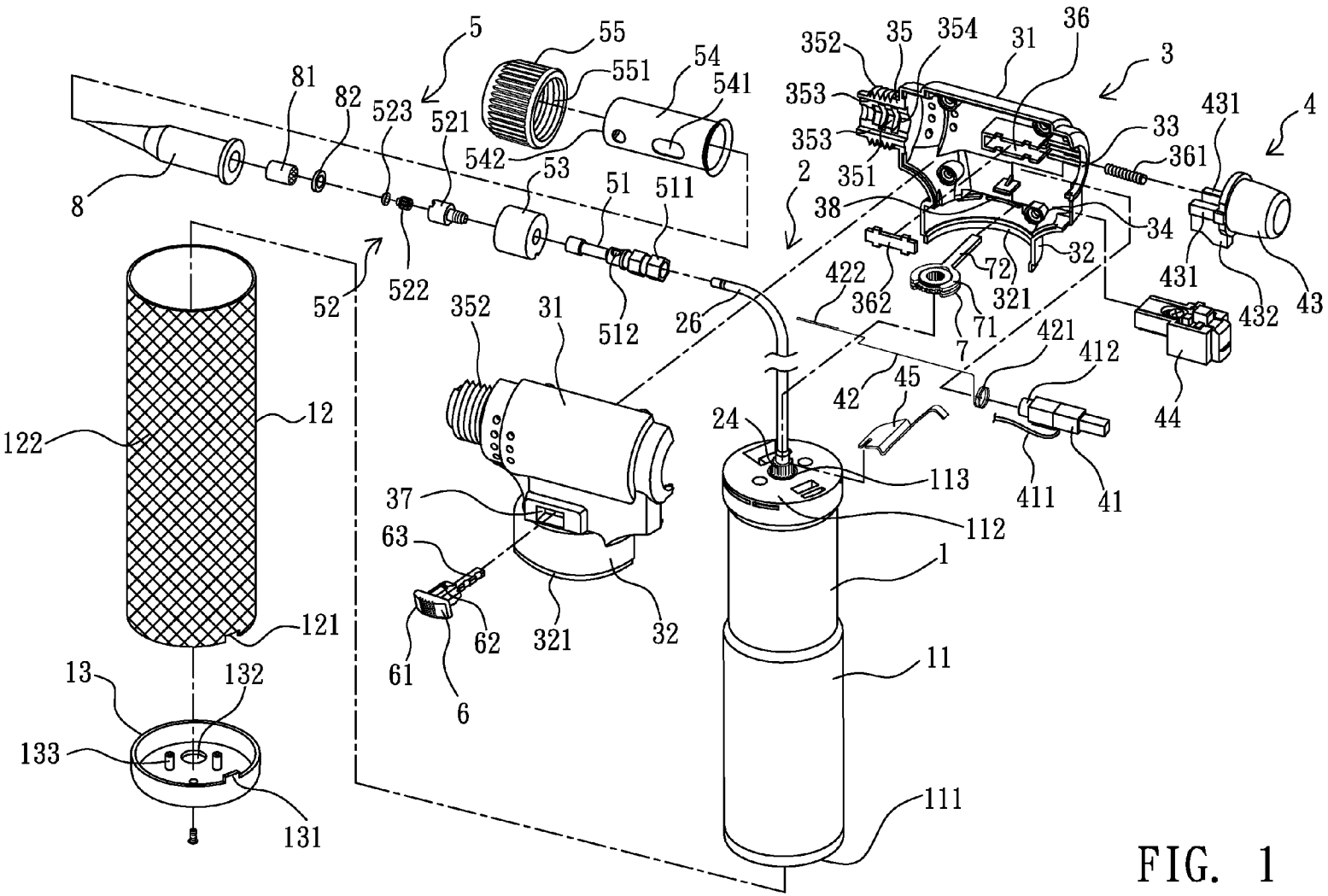
FIG. 1 is a 3D exploded view of the hand-held gas combustion apparatus provided by the present invention.
Figure 2:
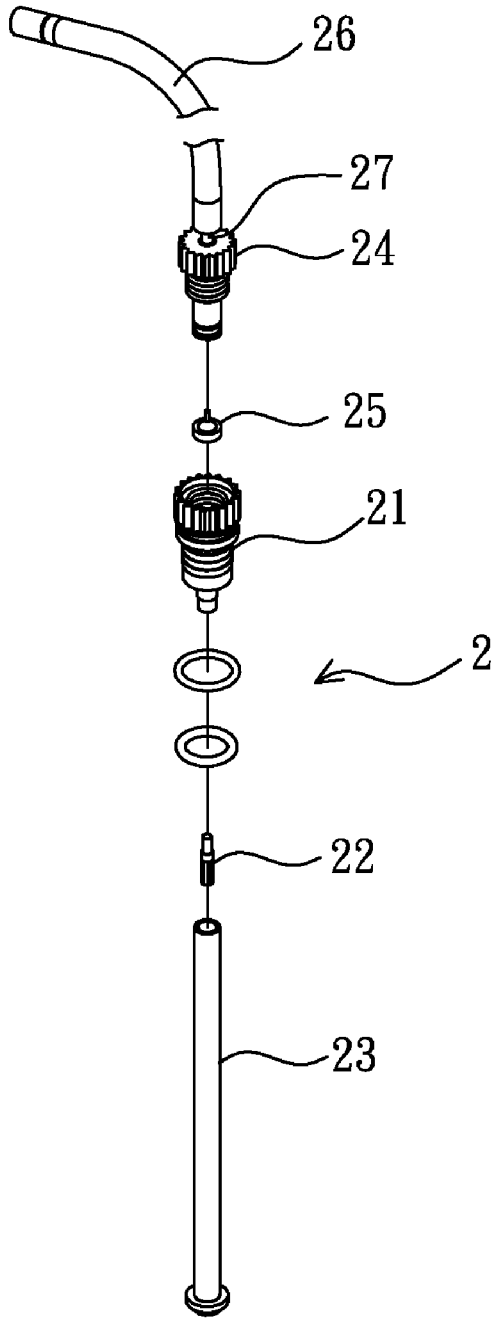
FIG. 2 is a 3D exploded view of the gas discharging device provided by the present invention.

As shown from FIG. 1 to FIG. 2, the hand-held gas combustion apparatus provided by the present invention is composed by a gas storing tank 1, a gas discharging device 2, a housing 3, an ignition system 4 and a flame device 5.

The gas storing tank 1 is served to store liquefied gas, a tank bottom 111 provided on a bottom end of a tank body 11 of the gas storing tank 1 has a conventional gas filling nozzle (not shown) for being supplied with combustion fuel, and a tank top 112 provided at the top end of the tank body 11 has an opening 113 for receiving and positioning the gas discharging device 2. The difference between the gas storing tank 1 provided by the present invention and a conventional gas storing tank is that a foreign material can be provided on the tank body 11, e.g. an outer tube 12 made of aluminum alloy, a gap is defined between the outer tube 12 and the tank top 112 so when being connected to the housing 3, a connecting edge 321 extended from a connecting ring 32 can be mounted into the gap, then a bottom cover 13 is connected to the tank bottom 111 that is provided at the bottom end of the tank body 11 and is in a concave shape, and the bottom cover 13 is fastened on the tank bottom 111 via conventional connecting units, e.g. screws, passing through the bottom cover 13, so the top and the bottom ends of the outer tube 12 are provided between the housing 3 and the bottom cover 13 so as to be positioned.

By providing the outer tube 12 on the outer side of the gas storing tank 1, the structural strength and the rigidity are therefore enhanced. For preventing the outer tube 12 from rotating on the tank body 11, the periphery of the top end of the bottom cover 13 is protrudingly provided with a tenon 131 for being mounted into a cavity 121 preset at the bottom end of the outer tube 12. A through hole 132 is provided on the bottom cover 13 with respect to the location of the gas filling nozzle, and at least one positioning tenon 133 is protrudingly provided on the bottom surface of the bottom cover 13 for being mounted into tenon holes preset on the tank bottom 111. For increasing the holding sensation and the anti-slippery property of the outer tube 12, the surface of the outer tube 12 can be provided with 3D patterns 122.

As shown in FIG. 1 and FIG. 2, the gas discharging device 2 is a conventional gas discharging device in which a discharging nozzle 24 is provided on the opening 113 and is fastened thereon, the bottom end of the discharging nozzle 24 is provided with a discharging valve 21, the bottom end of the discharging valve 21 is provided with a slot rod 22 having plural thin slots radially provided, and the slot rod 22 is connected to a long engaging tube 23, the engaging tube 23 is extended into the inside of the tank body 11. A valve pin 25 is provided between the discharging valve 21 and the discharging nozzle 24, so by adjusting the distance between the valve pin 25 and the slot rod 22, so the flow rate of discharging is able to be controlled. The discharging nozzle 24 is provided with a gas conveying tube 26 and the other end thereof is provided with an ejecting nozzle 27; when the discharging nozzle 24 is pulled, the liquefied gas stored in the gas storing tank 1 is vaporized then is conveyed into the gas conveying tube 26 via the discharging nozzle 24, then is rapidly ejected by the ejecting nozzle 27 for entering the flame device 5.

Figure 3:
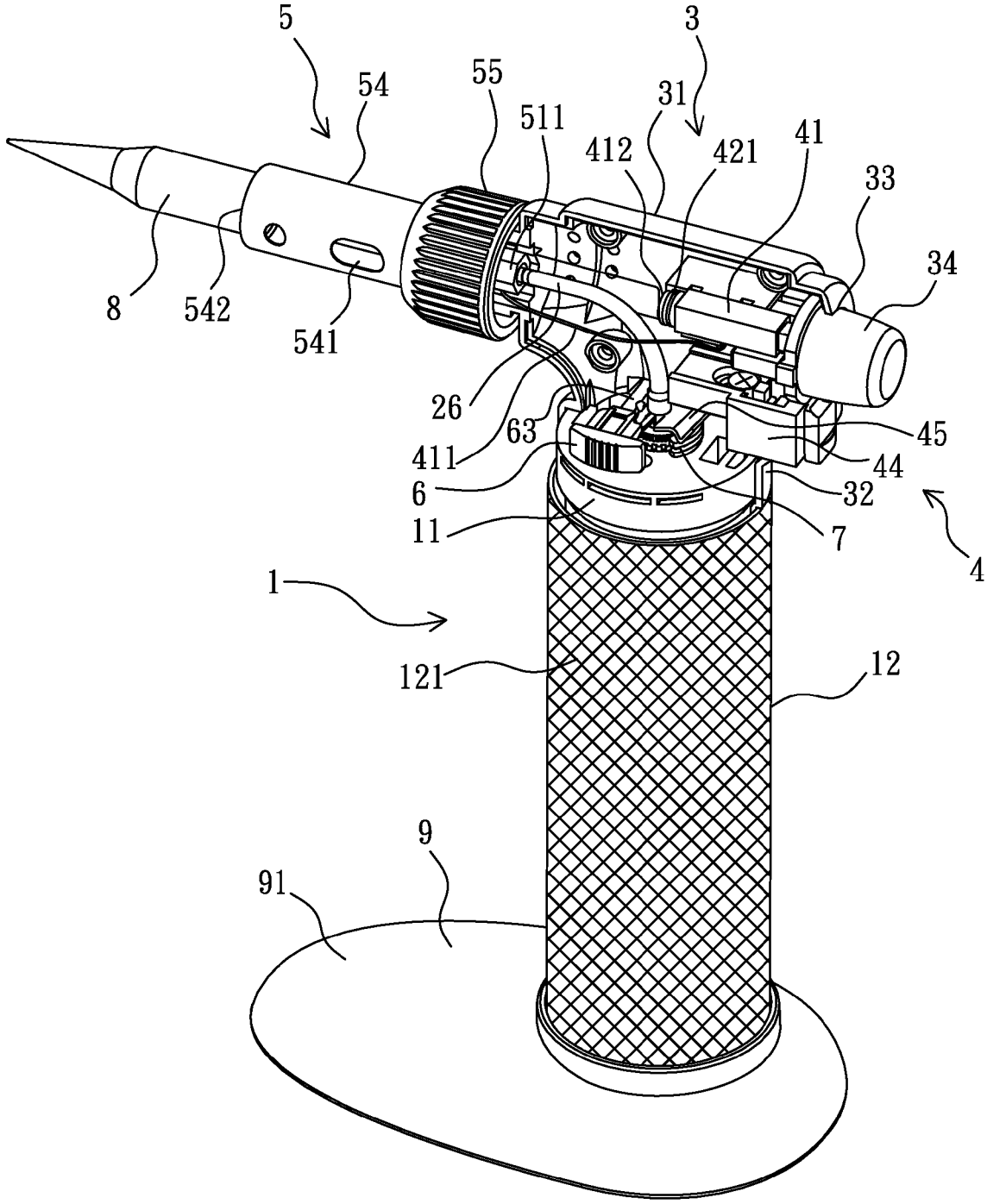
FIG. 3 is a schematic view of the assembled hand-held gas combustion apparatus having a cover member removed.

As shown in FIG. 1 and FIG. 3, the housing 3 is composed by two cover members 31 connecting together, so a ring-shaped connecting ring 32 is defined at the bottom end of the cover members 31 and the connecting ring 32 is served to cover the tank top 112 provided at the top end of the tank body 11, so the connecting edge 321 downwardly extended from the connecting ring 32 is mounted into the gap defined between the outer tube 12 and the tank top 112, the housing 3 is therefore retained on the gas storing tank 1. As shown in FIG. 1, after the two cover members 31 are connected together, a button hole 33, a key slot 34 and a housing tenon 35 are respectively provided at the top and the bottom ends of the right side and at the left side for receiving and positioning a button 43 of the ignition system 4 and a mixing tube 51 of the flame device 5.

A plurality of convex ribs are provided on the inner wall of the housing 3 so as to define plural accommodating spaces for accommodating and positioning units of the ignition system 4. As shown in FIG. 3, the feature of the present invention is that a polygonal positioning hole 351 is axially provided on the housing tenon 35 for receiving and positioning the mixing tube 51 of the flame device 5, and a portion of the surface of the housing tenon 35 has thread patterns 352 for being connected to a connecting ring 55; and a linear slot 353 is respectively and in parallel provided at the top and the bottom ends of the positioning hole 351 so an electricity-guiding wire 42 and a conductive wire 411 of the ignition system 4 can pass through and be received in the linear slots 353, and a concave slot 354 is radially provided on the positioning hole 351 for receiving and positioning the exposed metal end of the conductive wire 411, so when the metal end is connected to the mixing tube 51 which is also made of metals, the mixing tube 51 can also be served as a conductive object.

A piezoelectric device 41 of the ignition system 4 is fastened in the accommodating space defined at the inside of the button hole 33, and is provided with the conductive wire 411 whose exposed end is positioned in the concave slot 354 of the positioning hole 351. The feature of the ignition system 4 provided by the present invention is that the electricity-guiding wire 42 is further provided, one end of the electricity-guiding wire 42 defined as a connecting end 421 is connected to a metal electricity-guiding section 412 of the piezoelectric device 41, the other end thereof defined as a contacting end 422 is extended to the linear slot 353 provided at the top end of the positioning hole 351 of the housing tenon 35 for being in contact with a metal sleeve tube; for providing a better contacting effect to the contacting end 422, the contacting end 422 is bended to a folding status so as to have a proper elasticity for ensuring the contact with the metal sleeve tube is firm and stable.

The button 43 is provided in the button hole 33, the key slot 34 is provided below for receiving and positioning a safety actuating device 44 such as the safety actuating device disclosed at the Taiwan Patent No. 582519 which is designed by the applicant of the present invention. Before operation, a locking status of the safety actuating device 44 is firstly released so that the button 43 can be pressed. The inside of the button 43 is provided with the piezoelectric device 41, and a guiding tenon 431 is respectively and in parallel provided on the front and the rear ends of the inner side of the button 43, and each of the guiding tenons 431 is connected to tenon holes 36 preset on the inner wall of the housing 3 and is served to press against recovering units 361, e.g. springs, provided in the tenon slots 36, and the top opening end of each of the tenon slots 36 is sealed by a sealing sheet 362 so the recovering units 361 are prevented from falling off and the button 43 is therefore provided with a function of rapid recovering. So beside the elastic force provided by the piezoelectric device 41, each of the tenon slots 36 is provided with one of the recovering units 361, so when the button 43 is pressed, the button 43 can be rapidly recovered to an original position. The bottom end of one of the guiding tenons 431 of the button 43 is protrudingly provided with a pushing rod 432, when the pushing rod 432 is forwardly pushed, a discharging sheet 45 is in contact with and pushed by the pushing rod 432, so a torque is generated for lifting the discharging nozzle 24 of the gas discharging device 2 for supplying combustion gas.

For providing a function of continuous combustion to the present invention, a housing slot 37 of the housing 3 is provided with a continuing member 6, the top and the bottom ends of the continuing member 6 is respectively and protrudingly provided with a hooking rod 62 and a pulling rod 63 that are provided on a lateral side of a pulling sheet 61, the hooking rod 62 is connected to the housing slot 37 of the housing 3; by pulling the pulling rod 63 the discharging sheet 45 is lifted, and the pulling rod 63 is extended into the inside of the discharging sheet 45 and is served to press against the discharging nozzle 24, so the discharging nozzle 24 is supported by the pulling rod 63 for obtaining a status of continuously supplying gas.

The hand-held gas combustion apparatus provided by the present invention is further provided with a regulating member 7, a connecting ring 71 is served to connect to the discharging nozzle 24, a regulating rod 72 laterally extended is exposed outside a cover slot 38 of the housing 3. By pulling the regulating rod 72, the discharging nozzle 24 is rotated with the rotation of the connecting ring 71 for regulating the discharging amount of the combustion gas.

The flame device 5 has the mixing tube 51, the rear end of the mixing tube 51 is provided with at least one polygonal, e.g. hexagonal, tube end 511 for being clamped in the positioning hole 351, the tube end 511 is served to let the ejecting nozzle 27 mount into, so the combustion gas can be filled into the mixing tube 51 via an ejecting fashion. At least one air intake hole 512 is provided at the lateral side of the mixing tube 51, so when the vaporized combustion gas flows within the mixing tube 51, an airflow is generated so external air can be induced and pass through the air intake hole 512 and flow into the mixing tube 51 for a mixing operation for facilitating the combustion. The mixed combustion gas after being mixed is ejected by a flame nozzle 52 provided at the front end of the mixing tube 51. The flame nozzle 52 is composed by a gear seat 521 being mounted into a flame gear 522 and a retaining pin 523 is provided for passing through the flame gear 522 and retain the flame gear 522 on the gear seat 521.

For achieving a better heat-insulating efficiency, a heat-insulating ring 53 is provided on the outer side of the flame nozzle 52, the heat-insulating ring 53 is a tube member made of ceramics, then a metal sleeve tube 54 is connected to the connecting ring 55, then the connecting ring 55 is screw-fit with the thread patterns 352 of the housing tenon 35 via an inner thread patterns 551, so the contacting end 422 of the electricity-guiding wire 42 is in contact with the rear end of the sleeve tube 54, and the flame nozzle 52 is provided in front of the sleeve tube 54. At least one air flowing slot 541 is provided on the sleeve tube 54 with respect to the location where the air intake hole 512 is provided for facilitating the air induction, and a small distance is generated between an inner folding edge 542 of the sleeve tube 54 and the flame nozzle 52. When the button 43 is pressed, the piezoelectric device 41 is compressed and the generated high-voltage static electricity passes through the conductive wire 411, the mixing tube 51 to the location of the flame nozzle 52, so a high-voltage static electricity spark is generated between the flame nozzle 52 and the inner folding edge 542 of the sleeve tube 54 and the mixed combustion gas ejected from the flame nozzle 52 is therefore ignited, so a gas combustion apparatus is obtained; and the high-voltage static electricity passes through the metal sleeve tube 54 and the electricity-guiding wire 42 then back to the piezoelectric device 41 so as to form a circuit.

Figure 5:
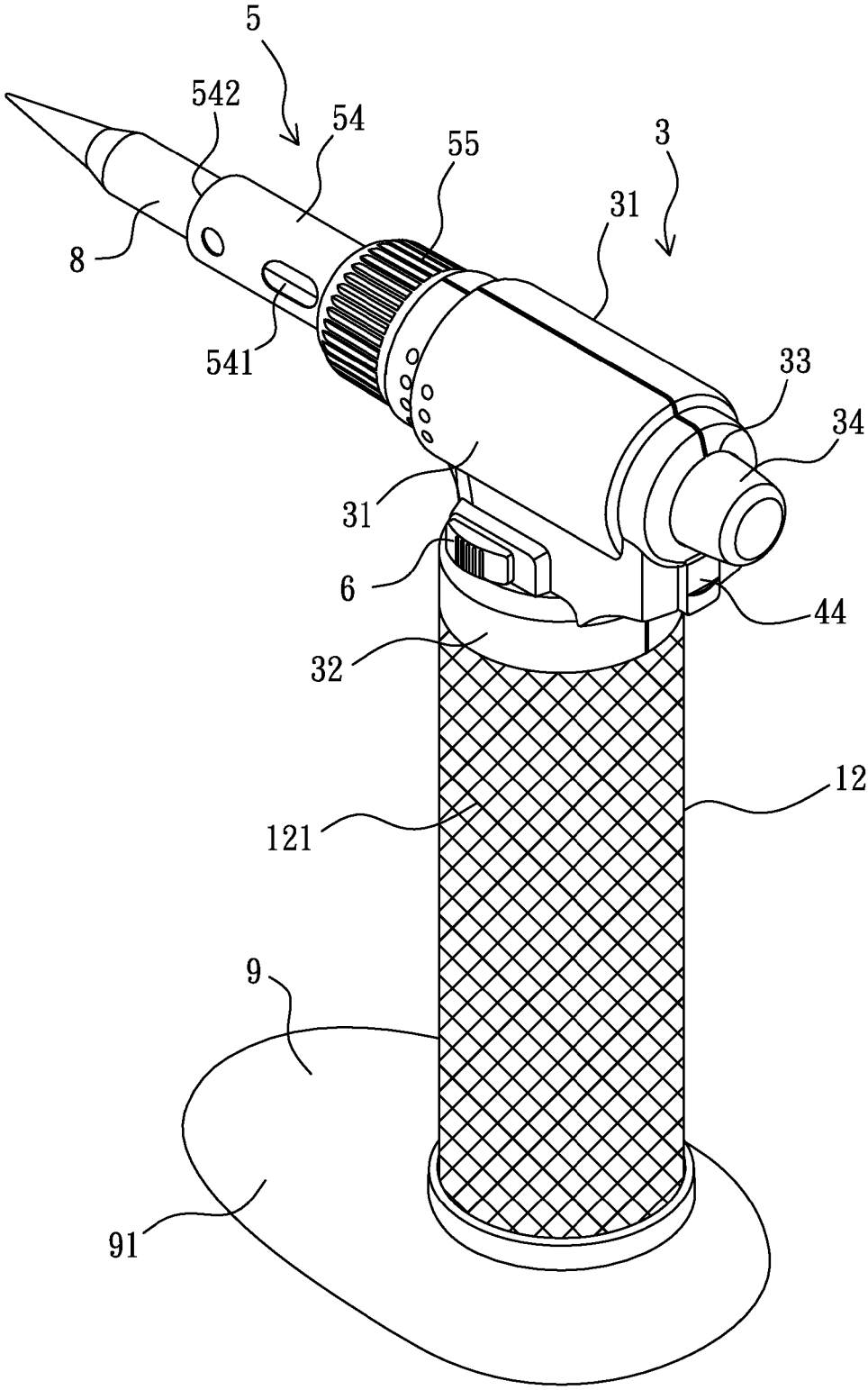
FIG. 5 is a 3D view of the hand-held gas combustion apparatus after being assembled.

The front end of the sleeve tube 54 can be provided with a soldering iron head 8 having a heating member 81 inside, the heating member 81 is positioned in the soldering iron head 8 by a retaining ring 82, so during the combustion, the flame is served to heat the soldering iron head 8, thus a gas soldering iron as shown in FIG. 5 is obtained.

Figure 4:
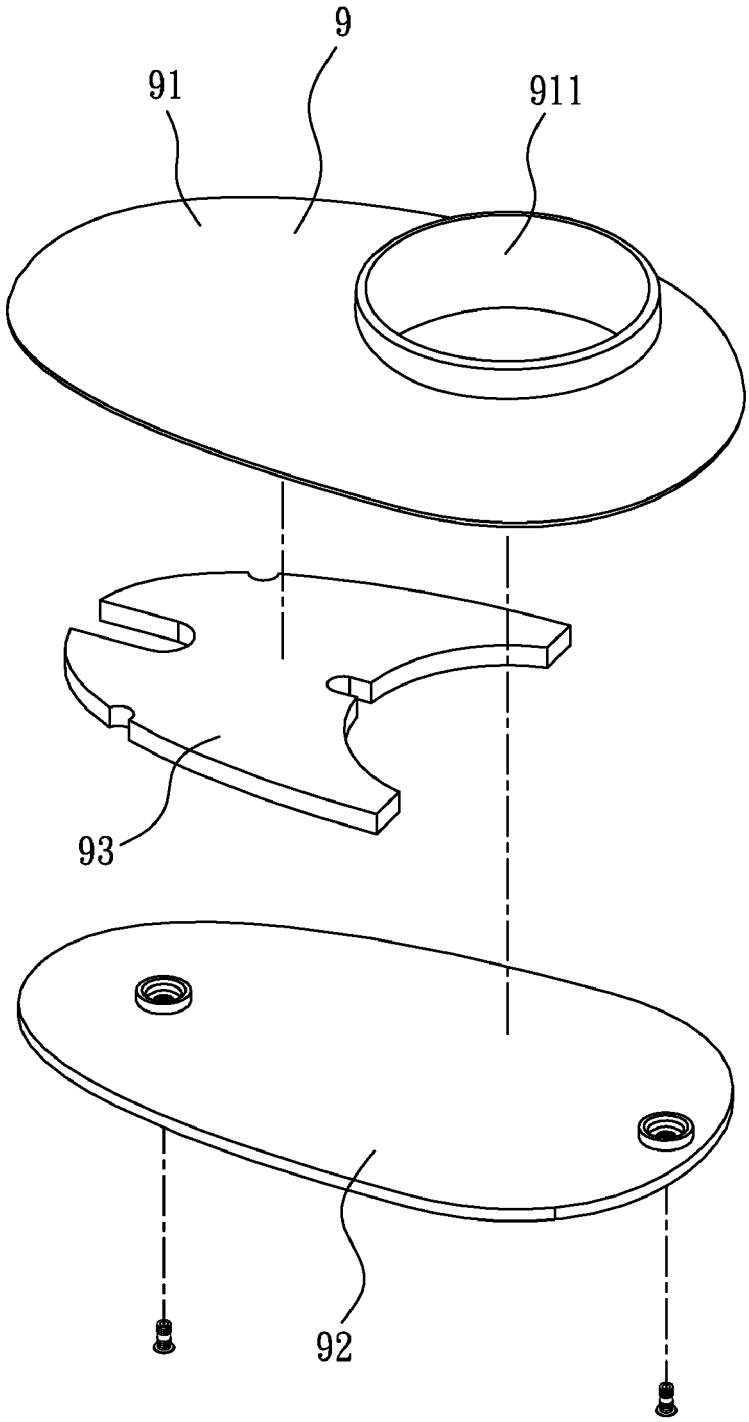
FIG. 4 is a 3D exploded view of the base seat provided by the present invention.

As shown in FIG. 4, after being assembled, the hand-held gas combustion apparatus provided by the present invention is in a T shape, for increasing the position stability, the gas storing tank 1 can be provided at one side of a long base seat 9 which is composed by a top cover 91 and a bottom cover 92 connecting together, a weight balancing block 93 is provided between the top cover 91 and the bottom cover 92 for increasing the stability. One side of the top cover 91 is provided with a tank slot 911 for being connected to the bottom end of the gas storing tank 1.

The present invention has overcome the disadvantages that a conductive wire of a conventional ignition system has to be provided at one side of the flame nozzle and the inconvenience of circuit design, and in the present invention there is no need of providing additional supporting racks for receiving and positioning the ignition system and the flame device so the production cost can be reduced; and the flame nozzle of the flame device and the metal sleeve tube are respectively in contact with the conductive wire and the electricity-guiding wire of the ignition system, so a static electricity spark is negated between the flame nozzle and the inner folding edge of the metal sleeve tube for igniting the mixed combustion gas ejected from the flame nozzle, so a gas combustion apparatus is obtained, and the electricity-guiding wire is provided between the metal sleeve tube and the ignition system, the electricity-guiding wire can be served to guide the high-voltage static electricity back to the ignition system so as to form a circuit. The units of the present invention can be designed to be modulized, and combustion tools, e.g. a combustion device or a soldering iron, can be adopted.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A hand-held gas combustion apparatus, comprises:

a gas storing tank, an opening is provided on a tank top provided at a top end of a tank body, a tank bottom is provided at the bottom end of the tank body and is provided with a gas filling nozzle;

a gas discharging device, a discharging nozzle is provided on the opening for controlling the supplying/ceasing of combustion gas, the discharging nozzle is connected to a gas conveying tube and the other end thereof is connecting to an ejecting nozzle;

a housing composed by two cover members connecting together, so a housing tenon and a button hole are respectively formed on the two lateral ends, and a connecting ring provided at the bottom end is connected to the tank top of the gas storing tank, a polygonal positioning hole is axially provided on the housing tenon and the top end and the bottom end of the housing tenon is respectively and in parallel provided with a linear slot;

an ignition system, a piezoelectric device is fastened in the housing and the rear end of the piezoelectric device is connected to a button extruding out of the button hole, the button is extrudingly provided with a pushing rod that can be served to actuate a discharging sheet so the discharging nozzle is operated to supply gas, a conductive wire is extended from the piezoelectric device and is received in one of the linear slots, and the metal exposed portion of the conductive wire is fastened in the positioning hole, and one end of an electricity-guiding wire defined as a connecting end is connected to a metal electricity-guiding section of the piezoelectric device, and the other end thereof defined as a contacting end is extended into the other linear slot;

a flame device, a polygonal tube end defined at a rear end of a mixing tube is clamped in the positioning hole so as to be in contact with the conductive wire, and the tube end is served to let the ejecting nozzle being mounted into, at least one air intake hole is provided at the lateral side of the mixing tube, and the front end of the mixing tube is provided with a flame nozzle, and a metal sleeve tube is connected to a connecting ring then the connecting ring is connected to the housing tenon, so the contacting end of the electricity-guiding wire is in contact with the rear end of the sleeve tube, and the flame nozzle is provided in front of the sleeve tube, a small distance is generated between an inner folding edge provided at the front end of the sleeve tube and the flame nozzle for generating a high-voltage static electricity spark which is served to ignite the mixed combustion gas ejected from the flame nozzle.

2. The hand-held gas combustion apparatus as claimed in claim 1, wherein the tank body is provided with an outer tube, a gap is defined between the outer tube and the tank top so when being connected to the housing, a connecting edge extended from a connecting ring can be mounted into the gap; a bottom cover is connected to the tank bottom that is provided at the bottom end of the tank body and is in a concave shape, so the top and the bottom ends of the outer tube are provided between the housing and the bottom cover.

3. The hand-held gas combustion apparatus as claimed in claim 2, wherein the periphery of the top end of the bottom cover is protrudingly provided with a tenon for being mounted into a cavity preset at the bottom end of the outer tube, and a through hole is provided on the bottom cover with respect to the location of the gas filling nozzle.

4. The hand-held gas combustion apparatus as claimed in claim 2, wherein the surface of the outer tube is provided with 3D patterns.

5. The hand-held gas combustion apparatus as claimed in claim 1, wherein the bottom end of the discharging nozzle is provided with a discharging valve, the bottom end of the discharging valve is provided with a slot rod having plural thin slots radially provided, and the slot rod is connected to a long engaging tube that is extended into the inside of the tank body, a valve pin is provided between the discharging valve and the discharging nozzle, so by adjusting the distance between the valve pin and the slot rod, so the flow rate of discharging is able to be controlled.

6. The hand-held gas combustion apparatus as claimed in claim 1, wherein a concave slot is radially provided on the positioning hole for receiving and positioning the exposed metal end of the conductive wire.

7. The hand-held gas combustion apparatus as claimed in claim 6, wherein the contacting end of the electricity-guiding wire is bended to a folding status so as to have a proper elasticity.

8. The hand-held gas combustion apparatus as claimed in claim 1, wherein the key slot is provided below the button hole of the button for receiving and positioning a safety actuating device.

9. The hand-held gas combustion apparatus as claimed in claim 1, wherein a guiding tenon is respectively and in parallel provided on the front and the rear ends of the inner side of the button, and the guiding tenons are connected to tenon holes preset on the inner wall of the housing and are served to press against recovering units provided in the tenon slots, and the top opening end of each of the tenon slots is sealed by a sealing sheet.

10. The hand-held gas combustion apparatus as claimed in claim 1, wherein the hand-held gas combustion apparatus is further provided with a continuing member, the top and the bottom ends of the continuing member are respectively and protrudingly provided with a hooking rod and a pulling rod that are provided on a lateral side of a pulling sheet, the hooking rod is connected to the housing slot of the housing; when the discharging sheet of the ignition system is operated and the discharging nozzle of the gas discharging device is lifted, the pulling rod is pulled and is extended into the inside of the discharging sheet and is served to press against the discharging nozzle for obtaining a status of continuously supplying gas.

11. The hand-held gas combustion apparatus as claimed in claim 1, wherein the hand-held gas combustion apparatus is further provided with a regulating member, a connecting ring is served to connect to the discharging nozzle of the gas discharging device, a regulating rod laterally extended from the regulating member is exposed outside a cover slot of the housing; by pulling the regulating rod, the discharging nozzle is rotated with the rotation of the connecting ring for regulating the discharging amount of the combustion gas.

12. The hand-held gas combustion apparatus as claimed in claim 1, wherein the flame nozzle is composed by a gear seat being mounted into a flame gear and a retaining pin is provided for passing through the flame gear and retain the flame gear on the gear seat.

13. The hand-held gas combustion apparatus as claimed in claim 1, wherein a heat-insulating ring is provided on the outer side of the flame nozzle, the heat-insulating ring is a tube member made of ceramics.

14. The hand-held gas combustion apparatus as claimed in claim 1, wherein at least one air flowing slot is provided on the sleeve tube with respect to the location where the air intake hole is provided.

15. The hand-held gas combustion apparatus as claimed in claim 1, wherein the front end of the sleeve tube is provided with a soldering iron head.

16. The hand-held gas combustion apparatus as claimed in claim 15, wherein a heating member is provided inside the soldering iron head, the heating member is positioned in the soldering iron head by a retaining ring.

17. The hand-held gas combustion apparatus as claimed in claim 1, wherein the hand-held gas combustion apparatus is further provided with a base seat which is composed by a top cover and a bottom cover connecting together, a weight balancing block is provided between the top cover and the bottom cover, one side of the top cover is provided with a tank slot for being connected to the bottom end of the gas storing tank.

* * * * *